US009808705B2

(12) United States Patent
Treadway et al.

(10) Patent No.: US 9,808,705 B2
(45) Date of Patent: Nov. 7, 2017

(54) WEARABLE PERSONAL TRANSPORTATION SYSTEM

(71) Applicant: ACTON, INC., Altadena, CA (US)

(72) Inventors: Peter Treadway, Arcadia, CA (US); Janelle Wang Treadway, Arcadia, CA (US); Hang Zheng, Pasadena, CA (US)

(73) Assignee: ACTON, INC., Altadena, CA (US)

( * ) Notice: Subject to any disclaimer, the term of this patent is extended or adjusted under 35 U.S.C. 154(b) by 0 days.

(21) Appl. No.: 14/736,064

(22) Filed: Jun. 10, 2015

(65) Prior Publication Data

US 2015/0352430 A1 Dec. 10, 2015

Related U.S. Application Data

(60) Provisional application No. 62/010,327, filed on Jun. 10, 2014.

(51) Int. Cl.
*A63C 17/12* (2006.01)
*A63C 17/06* (2006.01)
(Continued)

(52) U.S. Cl.
CPC ..... *A63C 17/12* (2013.01); *A63C 17/0046* (2013.01); *A63C 17/061* (2013.01);
(Continued)

(58) Field of Classification Search
CPC ..... A63C 17/12; A63C 17/04; A63C 17/26; A63C 17/0046; A63C 17/061
(Continued)

(56) References Cited

U.S. PATENT DOCUMENTS 4,307,366 A * 12/1981 Fujita ..... G01D 5/2258 336/136
5,048,632 A * 9/1991 Battel ..... A63C 17/12 180/181
(Continued)

FOREIGN PATENT DOCUMENTS

CN 202920943 U * 5/2013
JP 2004024614 A * 1/2004
(Continued)

OTHER PUBLICATIONS

Rudd, Robert, "Estimating the Mu Slip Curve via Extended Kalman Filtering", The Mathematica Journal, 11:1, 2008, pp. 91 to 106.*
(Continued)

*Primary Examiner* — Behrang Badii
*Assistant Examiner* — David Testardi

(57) ABSTRACT

Motorized skating systems and methods for controlling the systems are disclosed. One exemplary system may include a primary skate and a secondary skate. The primary skate may include a sensor configured to detect a tilting signal. The primary skate may also include a first processor. The processor may be configured to determine a first control signal for moving the primary skate based on the tilting signal and determine a motion signal for moving the secondary skate based on the first control signal. The primary skate may further include a first communication interface configured to send the motion signal to the secondary skate. The secondary skate may include a second communication interface configured to receive the motion signal from the first communication interface. The secondary skate may also include a second processor configured to determine a second control signal for moving the secondary skate based on the received motion signal.

14 Claims, 6 Drawing Sheets

(51) Int. Cl.
*A63C 17/00* (2006.01)
*A63C 17/26* (2006.01)
*A63C 17/04* (2006.01)

(52) U.S. Cl.
CPC ..... *A63C 17/006* (2013.01); *A63C 17/04* (2013.01); *A63C 17/26* (2013.01); *A63C 2203/18* (2013.01)

(58) Field of Classification Search
USPC ..... 180/180, 181
See application file for complete search history.

(56) References Cited

U.S. PATENT DOCUMENTS 5,236,058 A * 8/1993 Yamet ..... A63C 17/12 180/181
6,059,062 A * 5/2000 Staelin ..... A43B 5/16 180/181
6,428,050 B1 8/2002 Brandley et al.
6,604,593 B1 * 8/2003 Mullet ..... A63C 17/20 180/181
7,178,614 B2 * 2/2007 Ishii ..... B60K 1/02 180/218
7,293,622 B1 * 11/2007 Spital ..... A63C 17/12 180/180
8,167,074 B1 5/2012 Tsiyoni
8,186,462 B2 * 5/2012 Kamen ..... A63C 17/01 180/19.1
2003/0063655 A1 * 4/2003 Young ..... H04W 8/005 375/132
2004/0055796 A1 * 3/2004 Kamen ..... A63C 17/01 180/21
2005/0082099 A1 * 4/2005 Tuli ..... A43B 3/0005 180/181
2005/0121238 A1 * 6/2005 Ishii ..... A63C 17/08 180/65.1
2007/0123166 A1 * 5/2007 Sheynman ..... H04M 1/7253 455/41.2
2007/0296170 A1 12/2007 Field et al.
2011/0231050 A1 9/2011 Goulding
2013/0158759 A1 * 6/2013 Oh ..... A63C 17/12 701/22
2013/0282216 A1 * 10/2013 Edney ..... A63C 17/12 701/22
2015/0019020 A1 * 1/2015 Hille ..... A47C 20/041 700/275

FOREIGN PATENT DOCUMENTS

JP 2010227491 A * 10/2010
JP 2013043055 A * 3/2013
WO WO 03/068342 A1 * 8/2003
WO WO 2013/065038 A1 * 5/2013

OTHER PUBLICATIONS

Chang, Richard et al., "Formal Analysis of Authentication in Bluetooth Device Pairing", Foundations of Computer Security and Automated Reasoning for Security Protocol Analysis, FCS-ARSPA'07, Wroclaw, Poland, Jul. 8, 2007, 17 pages.*
Cross, Daniel et al., "Detecting Non-Discoverable Bluetooth Devices", in IFIP International Federation for Information Processing, vol. 253, Critical Infrastructure Protection, eds. E. Goetz and S. Shenoi; (Boston: Springer), 2008, pp. 281-293.*
Haataja, K. et al., "Overview of Bluetooth Security", Chapter 2 in Bluetooth Security Attacks, SpringerBriefs in Computer Science, 3, 2013, 12 pages.*
Jazar, Reza N., Vehicle Dynamics: Theory and Application, Chapter 10: Vehicle Planar Dynamics, 2008, Springer US, pp. 583-664.*
PCT International Search Report and Written Opinion mailed Sep. 15, 2015, issued in corresponding International Application No. PCT/US2015/035160 (14 pages).

* cited by examiner

WEARABLE PERSONAL TRANSPORTATION SYSTEM

CROSS REFERENCE TO RELATED APPLICATION

The present application claims the benefit of priority to U.S. Provisional Application No. 62/010,327, filed Jun. 10, 2014, the entire content of which is incorporated herein by reference.

TECHNICAL FIELD

This disclosure relates generally to personal transportation system. More specifically, it relates to a wearable motorized skating system or motorized shoes.

BACKGROUND

Skates such as roller skates, inline skates, skateboards are commonly used as recreational or sporting equipment. A skate often includes a supporting structure (e.g., a frame for embracing a shoe, a shoe, a board, etc.) with a moving part (e.g., one or more wheels) attached thereon. Usually, a skate is not powered. Some skateboards may be powered by an electric motor. However, existing motor driving systems for skates are merely simple, primitive add-ons to the mechanical skates for the purpose of providing a limited range. These motorized systems do not have the ability to communicate with other peer systems to achieve concerted motion control of the skates.

Therefore, it is desirable to develop an improved motorized skating system with advance intelligence and controllability to achieve greater utility.

SUMMARY

One aspect of the present disclosure is directed to a motorized skating system. The system may include a primary skate and a secondary skate. The primary skate may include a sensor configured to detect a tilting signal indicating a tilting angle of the primary skate. The primary skate may also include a first processor. The processor may be configured to determine a first control signal for moving the primary skate based on the tilting signal. The processor may also be configured to determine a motion signal for moving the secondary skate based on the first control signal. The primary skate may further include a first communication interface configured to send the motion signal to the secondary skate. The secondary skate may include a second communication interface configured to receive the motion signal from the first communication interface of the primary skate. The secondary skate may also include a second processor configured to determine a second control signal for moving the secondary skate based on the received motion signal.

Another aspect of the present disclosure is directed to a method for controlling a motorized skating system including first and second skates. The method may include receiving, from a sensor, a signal indicating a motion of the first skate. The method may also include determining a first control signal for moving the first skate based on the received signal. The method may further include determining a motion signal for moving the second skate based on the first control signal. Moreover, the method may include controlling a communication interface to send the motion signal to the second skate to control a motion of the second skate.

A further aspect of the present disclosure is directed to a personal transportation system. The personal transportation system may include a first skate including a first transceiver and a second skate including a second transceiver. The first transceiver may be configured to send signals to the second transceiver.

Additional objects and advantages of the present disclosure will be set forth in part in the following detailed description, and in part will be obvious from the description, or may be learned by practice of the present disclosure. The objects and advantages of the present disclosure will be realized and attained by means of the elements and combinations particularly pointed out in the appended claims.

It is to be understood that the foregoing general description and the following detailed description are exemplary and explanatory only, and are not restrictive of the invention, as claimed.

BRIEF DESCRIPTION OF THE DRAWINGS

The accompanying drawings, which constitute a part of this specification, illustrate several embodiments and, together with the description, serve to explain the disclosed principles.

DETAILED DESCRIPTION

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. As used herein and in the appended claims, the singular forms "a," "an," and "the" include plural references unless the context clearly dictates otherwise.

Figure 1:
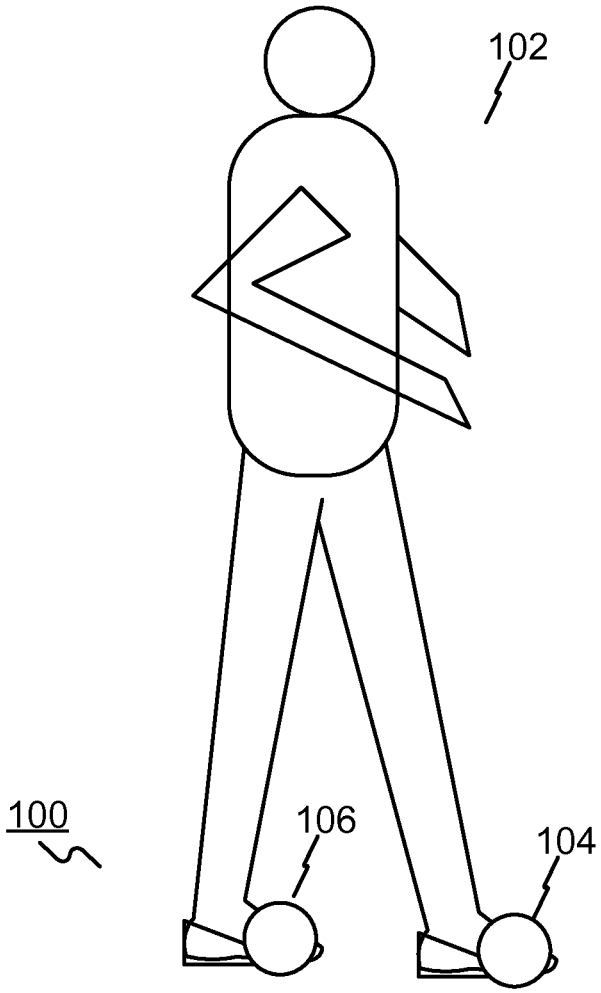
FIG. 1 illustrates an exemplary wearable motorized skating system, according to some embodiments of the present disclosure.

FIG. 1 illustrates an exemplary wearable motorized skating system 100, which may include a primary skate 104 and a secondary skate 106. Primary and secondary skates 104 and 106 may be wearable devices. For example, a user 102 may wear these skates on his/her feet. Primary and secondary skates 104 and 106 may include build-in motors and power sources to set user 102 in motion while user 102 wears these skates. Primary and/or secondary skates 104 and 106 may also include control means such that user 102 may control one or both skates, such as controlling start/stop, speed, etc.

As used herein, wearable motorized skating system 100 may also be referred to as wearable skating system 100 (also referred to as skating system 100, or system 100 for simplicity). Primary skate 104 may also be referred to master skate 104, master 104, controller skate 104, or controller 104. Similarly, secondary skate 106 may also be referred to as slave skate 106, slave 106, follower skate 106, or follower 106.

In some embodiments, primary skate 104 may be configured to provide primary control function for skating system 100. For example, primary skate 104 may include user control means for user 102 to operate. Upon operation, primary skate 104 may perform starting, accelerating, cruising, varying speed, braking, stopping, etc. Primary skate 104 may communicate with secondary skate 106 wirelessly to issue operation instructions to secondary skate 106 such that secondary skate 106 may follow primary skate 104 under the operation instructions. In some embodiments, primary and secondary skates 104 and 106 may have different hardware and/or software configurations. For example, unlike primary skate 104, secondary skate 106 may lack user control means and/or operation instruction issuing means. In other embodiments, however, primary and secondary skate may have the same hardware configuration, software configuration, or both. For example, each skate may be configured to be in primary or secondary mode (e.g., through hardware and/or software switch). Primary/secondary skate may correspond to either left/right or right/left skate, depending on user preference.

In some embodiments, skates 104 and 106 may work in tandem on an equal, or substantially equal, level to achieve consistent output. In such cases, the primary/secondary differences discussed above may be less important. For example, either skate may act as the primary skate at one time, and switch to the secondary mode at another time. In some embodiments, both skates may be contributor to the overall motion. In some cases, the output of the two skates may be intentionally set to be inconsistent, such as when lifting either foot in the air to adjust to terrain, or even for reasons of performance or styles.

Figure 2A:
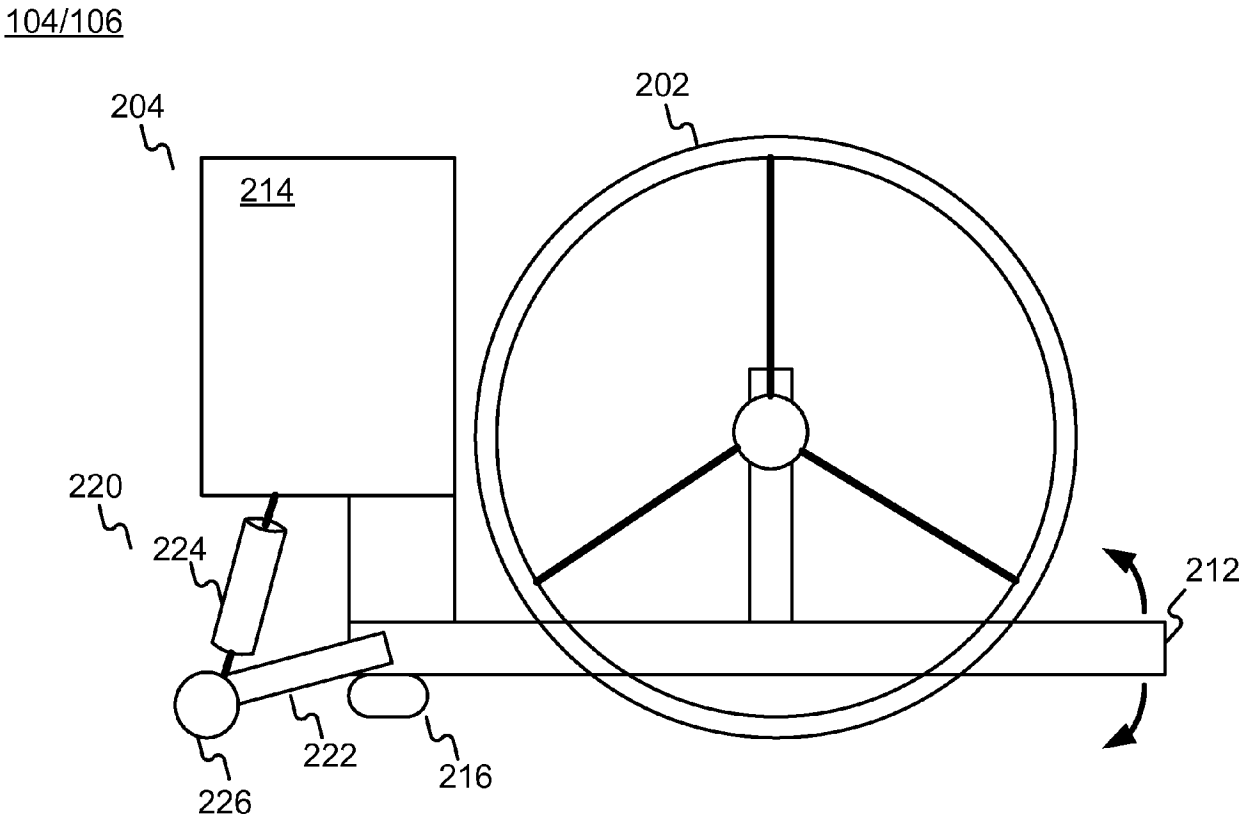
FIG. 2A illustrates an exemplary skate, according to some embodiments of the present disclosure.

FIG. 2A illustrates an exemplary skate, which may correspond to either primary skate 104 or secondary skate 106. In other words, the exemplary skate shown in FIG. 2A may include common features applicable to both primary and secondary skates 104 and 106. For simplicity, the exemplary skate shown in FIG. 2A will be referred to as skate 104. In FIG. 2A, skate 104 may include a main frame 204, a wheel system 202, and a suspension system 220. Main frame 204 may provide a skeleton of skate 104, to which wheel system 202 and suspension system 220 can attach. In some embodiments, main frame 204 may resemble a shoe-like structure, which embraces the foot (or foot with a shoe) of user 102. Main frame 204 may include a horizontal portion 212 and a vertical portion 214. Horizontal portion 212 may provide main support (e.g., horizontal support) to user 102, while vertical portion 214 may provide additional support (e.g., ankle support). Horizontal portion 212 may generally extend in parallel to the surface of the ground on which skate 104 is operated, but may not necessarily be horizontal in a strict manner. For example, horizontal portion 212 may tilt up and down with respect to the ground surface, or may form an angle with respect to sea level when, e.g., operating on a slope. Similarly, vertical portion 214 may not necessarily be vertical in a strict manner. Rather, vertical portion 214 may include any portion of main frame 204 that is not part of horizontal portion 212.

In some embodiments, horizontal portion 212 and vertical portion 214 may be part of a single-piece structure. For example, main frame 204 may be made from a single-piece material such as metal, metal alloy, plastic, wood, etc., such that horizontal portion 212 and vertical portion 214 are part of the single-piece main frame 204. In other embodiments, horizontal portion 212 and vertical portion 214 may include different pieces of main frame 204. The different pieces of main frame 204 may connect/attach to one another.

Wheel system 202 may include one or more wheels capable of moving skate 104 (e.g., with user 102 wearing skate 202). Wheel system 202 may attach to main frame 204 via one or more rotation joints. In some embodiments, wheel system 202 may include a built-in driving system (e.g., motor(s) and/or motor driver(s)), a power source (e.g., one or more batteries), or other active components. In other embodiments, wheel system 202 may include only passive components, such as wheels, bearings, axles, etc.

In some embodiments, wheel system 202 may include removable tires. The tires may also include wheel spokes. User 102 may change the tires with different designs by detaching the old tires and attaching the new tires. Wheels can have different diameters, offsets, weights, or widths.

Suspension system 220 may include a swing arm 222, a rear wheel 226, and a shock absorber 224. Rear wheel 226 may be connected to vertical portion 214 through shock absorber 224. In some embodiments, suspension system 220 may include two or more rear wheels. Rear wheel 226 may be configured to provide stability support and tilting angle determination, as discussed in greater detail below. In some embodiments, rear wheel 226 may also be configured to provide driven force, e.g., to be driven by a motor.

Shock absorber 224 may include a spring coil so that the position of rear wheel 226 may vary with respect to vertical portion 214. Shock absorber 224 may improve comfort and absorb shocks due to road imperfections. In addition, shock absorber 224 may be part of speed control, as discussed below. Rear wheel 226 may be connected to horizontal portion 212 through swing arm 222. Swing arm 222 may be movably coupled to horizontal portion 212. For example, swing arm 222 may be coupled to horizontal portion 212 through a linear or rotating potentiometer, such that when user 102 presses his/her toes (or heel) down, the spring coil of shock absorber 224 relaxes (or compresses) and horizontal portion 212 tilts down (or up). Swing arm 222 may then move linearly or rotate with respect to horizontal portion 212, thereby generating a signal indicating the degree of tilting of horizontal portion 212. The signal may be used to control/operate skate 104.

User 102 may press his/her toes (or heel) down while keeping his/her body straight. In some circumstances, user 102 may also lean forward (or backward), thereby causing horizontal portion 212 to tilt down (or up).

Main frame 204 may include a mechanical stopper 216, such as a rubber stopper, for emergency stop. In some embodiments, mechanical stopper 216 may be located in front of rear wheel 226.

In some embodiments, skate 104 may include a display device, such as an LED display, an LCD display, etc., to display information of skate 104. For example, the display device may display battery information such as the battery capacity (e.g., a battery energy bar), charging indication, low power warning, etc. In another example, the display device may display connection information such as connection status with other skate(s), connection status with mobile device (e.g., smart phone), etc. In yet another example, the display device may display travel information such as speed, distance traveled, route information, map, GPS location, calories burned, etc.

In some embodiments, skate 104 may include an audio output device, such as a speaker. For example, the audio output device may convey alerts to user 102 through sound. In some embodiments, the audio output device may output audible signals indicating turning on, turning off, changing of status, musical accompaniments, etc.

Horizontal portion 212 and/or vertical portion 214 may include one or more control devices (e.g., microcontrollers, sensors, etc.) and power devices (e.g., motors, batteries, etc.). In some embodiments, control/power devices may be installed in vertical portion 214.

Figure 2B:
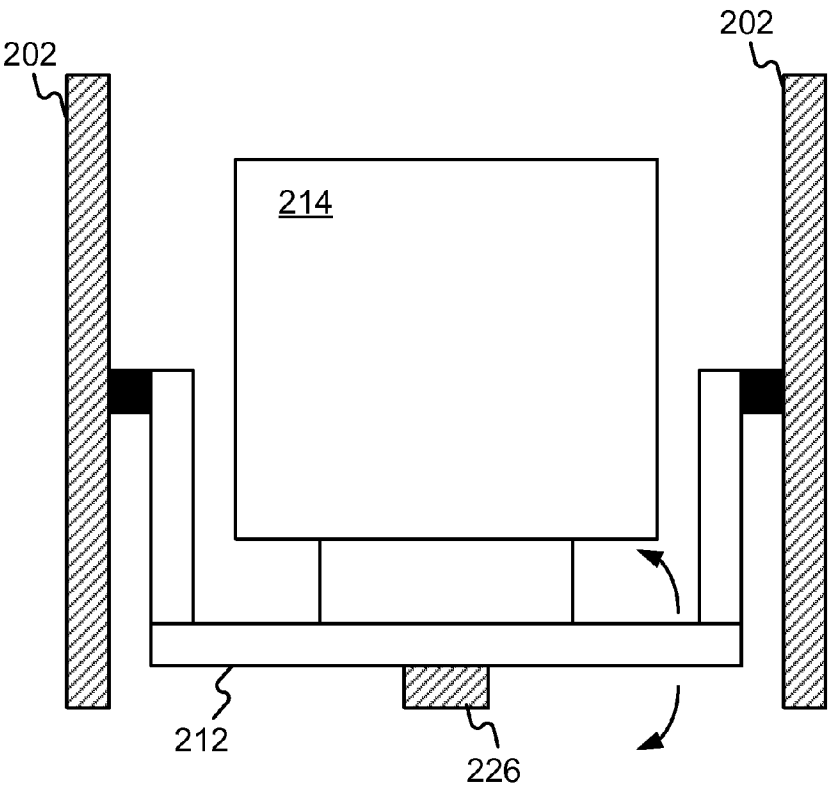
FIG. 2B illustrate another view of the exemplary skate of FIG. 2A, according to some embodiments of the present disclosure.

FIG. 2B illustrates another view of the skate shown in FIG. 2A. Referring the FIG. 2B, horizontal portion 212 may be tilted from side to side. For example, when user 102 wants to make a left/right turn, he/she may lean toward left/right. In this process, he may tilt the horizontal portion 212 to the left as well (e.g., the left side of horizontal portion 212 is lower than the right side). The tilting motion may be detected by sensors included in skate 104. The control device may then reduce the speed of the inside wheel to facilitate the turning action by, for example, supply less power to that inside wheel. In addition, the control device may also communicate with the other skate to control the speed of wheels of the other skate. Alternatively or additionally, the speed of the other skate may be controlled independently by the control device of the other skate. Accordingly, the speed of all four wheels can be individually controlled during a turning movement. For example, during a left turn, the speed of the left wheel on the left skate may be the lowest, followed by the right wheel on the left skate. The left wheel on the right skate may be faster than the right wheel on the left skate, and the right wheel on the right skate may be the fastest.

Figure 3:
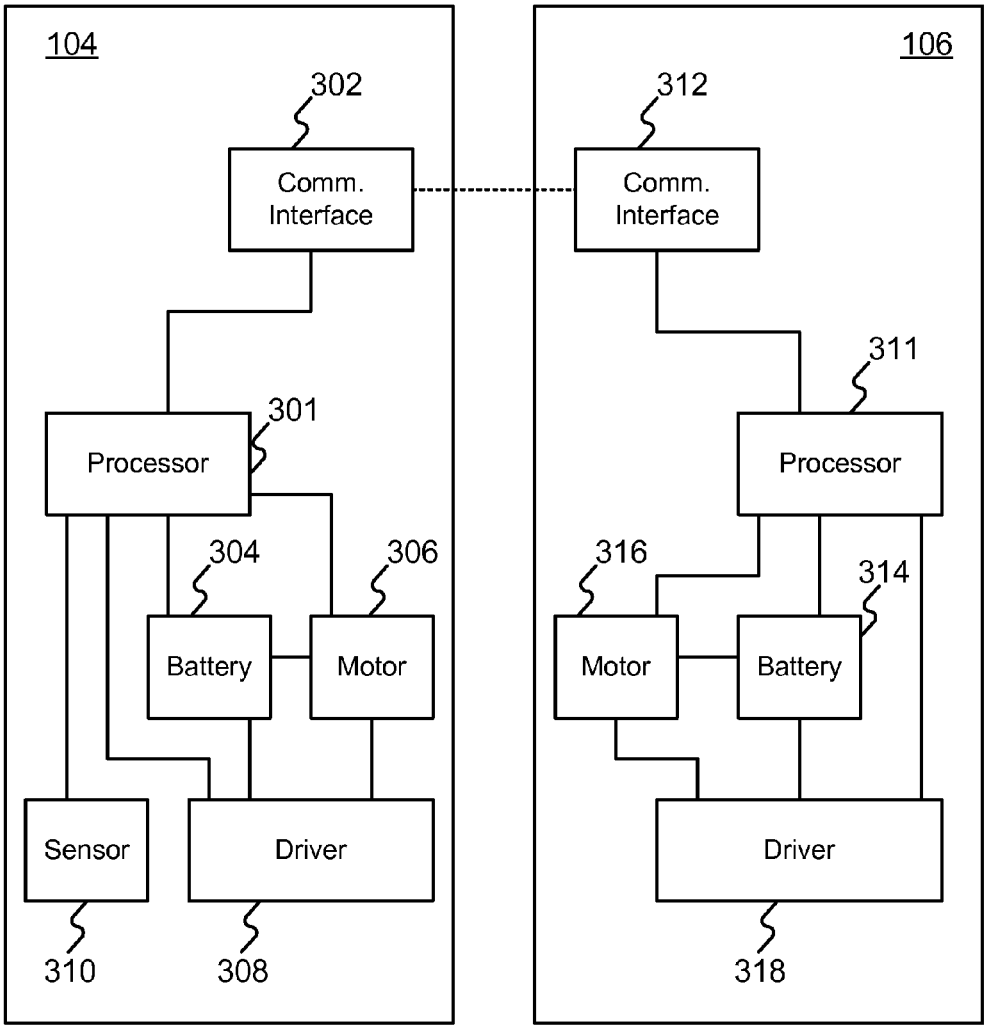
FIG. 3 illustrates exemplary functional block diagrams of primary and secondary skates, according to some embodiments of the present disclosure.

FIG. 3 illustrates exemplary functional block diagrams of primary and secondary skates 104 and 106. As shown in FIG. 3, primary skate 104 may include a processor 301, a communication interface 302, a battery 304, a motor 306, a driver 308, and a sensor 310. Processor 301 may be a microprocessor, a microcontroller, a micro control unit (MCU), or other suitable processing units capable of performing computational/logical operations. Processor 301 may communicate with sensor 310 to receive control signals. For example, sensor 310 may include a linear or rotating potentiometer that moves with swing arm 222 of suspension system 220. The movement of the potentiometer may correspond to the tilting angle of horizontal portion 212. When user 102 presses his/her toes down, horizontal portion 212 will tilt down with respect to ground surface. The tilting of horizontal portion 212 may cause the potentiometer to move or rotate towards a predetermined direction, which will in turn generate an electrical signal. The electrical signal may indicate the degree of tilting of horizontal portion 212. For example, the electrical signal may be proportional to the angle of tilting. Similarly, when user 102 presses his/her heel down, horizontal portion 212 will tilt up with respect to ground surface. The tilting-up of horizontal portion 212 may cause the potentiometer to move or rotate in an opposite manner compared to that when horizontal portion 212 tilts down. An electrical signal indicating the degree of tilting-up may be generated by the potentiometer in a similar manner to generating the electrical signal when horizontal portion 212 tilts down.

Processor 301 may issue control signals to control the movement of primary skate 104 based on input signals received from sensor 310. For example, processor 301 may receive signals indicating the degree of tilting of horizontal portion 212 from sensor 310. Based on the degree of tilting, processor 301 may start, stop, or control the speed of primary skate 104.

In some embodiments, processor 301 may start primary skate 104 by sending a start signal to driver 308. Upon receiving the start signal, driver 308 may apply power from, for example, battery 304, to motor 306. Motor 306 may apply torque to wheel system 202, which may start turning, thereby setting primary skate 104 in motion. In some embodiments, when user 102 presses his/her toes down, which in turn tilts horizontal portion 212 down, processor 301 may receive a signal from sensor 310 corresponding to such action and may treat the signal as a start signal. In some embodiments, processor 301 may control driver 308, which in turn may control motor 306 to apply torque to wheel system 202 commensurate with the angle of tilting of horizontal portion 212. For example, an inexperienced user may apply gentle force when pressing his/her toes down to start, resulting in a relatively small angle of tilting. In this case, processor 301 may control driver 308 to apply relatively low power to motor 306, which would in turn result in a slow and gentle start. In contrast, an experienced user may apply relatively large force when pressing his/her toes down to start, resulting in a relatively large angle of tilting. In this case, processor 301 may control driver 308 to apply relatively high power to motor 306, resulting in a quick and speedy start.

Once primary skate 104 starts moving, processor 301 may control the moving speed of primary skate 104 according to the tilting angle of horizontal portion 212, which may be detected by sensor 310. For example, processor may control driver 308 to output different power levels to motor 306 to control the moving speed of primary skate 104. In some embodiments, processor 301 may control driver 308 to output, for example, 25%, 50%, 75%, or 100% of maximum power level to motor 306 when the tilting angle of horizontal portion 212 is within certain predetermined ranges. For example, a linear arrangement can be configured, in which all tilting angles resulting from forward moving operation (e.g., toes down) may be divided into groups or zones. A still zone or buffer zone, for example, from zero degree to a relatively small angle (e.g., 10% of the full range), may be provided in which no power will be applied. Once the tilting angle is beyond the still zone and enter into the next zone, for example, a starting zone or low speed zone, primary skate 104 may be started at, for example, low speed with 25% power applied to motor 306. Next, if user 102 presses horizontal portion 212 further down, the tilting angle will enter into the next zone, for example, a mid-speed zone, in which primary skate 104 may move at mid-speed with 50% power applied to motor 306. Similarly, a high speed zone, corresponding to 75% power, and a super high speed zone, corresponding to 100% power, may also be setup.

In the above example, the percentage of power output, the number of zones, and the linear setup of zones, are only exemplary. Other configurations may also be used depending on particular circumstances and design preferences. For example, the high speed zone may be narrower than low speed zone out of safety concerns (e.g., high speeds may be achieved only if user 102 tilts horizontal portion really hard). For another example, processor 301 may control motor 306 to accelerate in response to the degree of tilting of horizontal portion 212 from sensor 310 without the zone settings. In this example, if horizontal portion 212 tilts forward (toes down) continuously, processor 301 may control motor 306 to accelerate continuously.

Processor 301 may control acceleration of primary skate 104 by applying higher and higher power to motor 306 corresponding to the tilting angle. Processor 301 may also perform deceleration control to reduce the speed of primary skate 104 through dynamic braking. For example, processor 301 may receive a braking signal from sensor 310 when, for example, the tilting angle of horizontal portion 212 reduces (e.g., when user 102 presses his/her heel down). Processor 301 may then control driver 308 to apply dynamic braking to motor 306. For example, driver 308 may control motor 306 to act as an electrical generator, thereby applying resistance to wheel system 202. In some embodiments, processor 301 may utilize the dynamic braking of motor 306 to recharge battery 304. In some embodiments, the deceleration process may use the same zone setting as the acceleration process. In other embodiments, the deceleration process may use different zone setting than the acceleration process. For example, the threshold tilting angle (e.g., A1) for a lower speed (e.g., corresponding to 25% power) to a higher speed (e.g., corresponding to 50% power) may be larger than the threshold tilting angle (e.g., A2, while A1>A2) from the higher speed (e.g., corresponding to 50% power) to the lower speed (e.g., corresponding to 25% power), such that when the skate just enters into the higher speed zone, a slight reduction of the tilting angle would not immediately bring the skate back to the lower speed zone.

In some embodiments, the braking signals may be detected when user 102 actively applies pressure on his/her heel. In other embodiments, the braking signals may be the same as coasting signals when user 102 removes forward pressure. For example, after accelerating skate 104 to a certain speed, user 102 may lift his/her toes slightly to coast. The action of lifting may reduce the tilting angle of horizontal portion 212, which may act as braking. In other words, the action of coasting may also be viewed as a soft braking.

In some embodiments, processor 301 may balance skate 104. For example, processor 301 may receive tilting angle information (e.g., up/down and/or left/right tilting) from sensor 310 and determine whether skate 104 is in a balanced or stable state. When it is determined that skate 104 may be out of balance or about to be out of balance, processor 310 may control driver 308 to output appropriate power to one or both wheels to regain balance.

As discussed above, user 102 may make turns when equipped with the skating system. Processor 301 may control the turning movement based on user input, such as titling sideways. Sensor 310 may detect the left/right tilting angle of horizontal portion 212, and send the information to processor 301. Processor 301 may then control driver 308 to output differential power to the inside and outside (with respect to the turn) wheels to facilitate the turning movement. For example, processor 301 may control the speed of the inside wheel to be lower than the speed of the outside wheel. In addition, processor 301 may communicate with processor 311 through communication interfaces 302, 312 to control the speed of all wheels during the turn. For example, when skate 104 is the inside skate (e.g., left skate during a left turn or right skate during a right turn), processor 301 may send signals to processor 311 such that processor 311 may control the speed of skate 106 to be higher than that of skate 104. Similarly, when skate 104 is the outside skate (e.g., right skate during a left turn or left skate during a right turn), the speed of skate 106 may be controlled to be higher than that of skate 104.

As discussed before, user 102 may also make emergency stop using mechanical stopper 216. For example, mechanical stopper 216 may be configured to touch ground and apply resistance when horizontal portion 212 tilts up over a certain angle. In some embodiments, mechanical stopper 216 may be configured to brake when the wheel speed is less than, for example, 10% of full speed. For example, mechanical stopper 216 may be designed with a determined height, and when horizontal portion 212 tilts backward (heel down) to a certain amount, for example, 10% of the full range of the potentiometer, the bottom of mechanical stopper 216 will touch the ground.

Mechanical braking may also be achieved by applying pressure directly to wheel system 202 through main frame 204 to slow down skate 104/106 due to the friction between wheel system 202 and main frame 204. In some embodiments, the friction between wheel system 202 and main frame 204 may be less than the friction between wheel system 202 and ground to avoid skidding.

In some embodiments, battery 304 may be removable/swappable and can be charged in or out of skate 104. For example, battery 304 may be mounted on the back inside vertical portion 214 and can be removed from the mounting location when skate 104 is turned off. The enclosure of vertical portion 214 may provide weather resistance to battery 304. Logos can be placed outside vertical portion 214 and can be doubled as the on/off switch. In some embodiment, battery 304 may be a high capacity Li-Polymer battery that allows for 8-10 miles of travel range. Battery 304 may also be other types of energy storage devices.

Processor 301 may monitor battery 304. For example, processor 301 may monitor the temperature, voltage, current, capacity, etc., of battery 304. Processor 301 may also monitor motor 306. For example, processor 301 may monitor the rotation speed, torque, state information, etc., of motor 306. In some embodiments, the state information of motor 306 may include states such as Go, Stop, Error, Idle, etc.

Communication interface 302 of primary skate 104 may include one or more transceivers that wirelessly communicate with communication interface 312 of secondary skate 106. For example, primary skate 104 may send motion information to secondary skate 106 through communication interfaces 302 and 312, so that secondary skate 106 may follow primary skate 104. The motion information may include torque to be applied to the wheel(s) of secondary skate 104, wheel speed, power to be applied to motor 316, state information of primary skate 104, or other information to facilitate the motion of secondary skate 106. Processor 311 of secondary skate 106 may receive the motion information from communication interface 312, and control driver 318 to apply power to motor 316 (e.g., through battery 314) based on the motion information. In some embodiments, the wheel speed of secondary skate 106 may be substantially the same as that of primary skate 104 as the result of the motion control based on motion information received from primary skate 104. In these embodiments, secondary skate 106 may effectively follow the motion of primary skate 104 and achieve substantial synchronization with primary skate 104. In some circumstances, the wheel speeds of primary and secondary skates may be different to accommodate particular situations, such as turning.

Similar to processor 301, processor 311 may monitor the temperature, voltage, current, capacity, etc., of battery 314.

Processor 311 may also monitor the rotation speed, torque, state information, etc., of motor 316. Processor 311 may feedback this monitoring information to primary skate 104 through communication interface 312. Processor 301 may process the feedback information and issue motion information accordingly. For example, if the feedback information indicates that secondary skate 106 is in an Error state, processor 301 may control driver 308 to stop primary skate 104 and also send a stop signal to secondary skate 106 through communication interface 302.

In some embodiments, primary/secondary skate 104/106 may include two or more wheels. The two or more wheels may be driven by a single motor, or by individual motors associated with each individual wheel. In case that multiple motors are provided, processor 301/311 may be configured to control each motor individually. For example, in case that both primary and secondary skates include two wheels and each wheel is driven by its own motor, processor 301 (and similarly processor 311) may control both motors in synchronization mode during straight movement, and may control the two motors to have different speeds during turning movement.

Primary and secondary skates 104 and 106 may establish communication upon power on or at any time during operation. Each skate may include identification information and pairing information. The identification information may be unique to the skate, such as a code, an address, a frequency or a sequence of frequencies, etc. The pairing information may include the identification of another skate that to be paired with. Both the identification information and the pairing information may be configured by the manufacture of the skate or by the end user.

Figure 4:
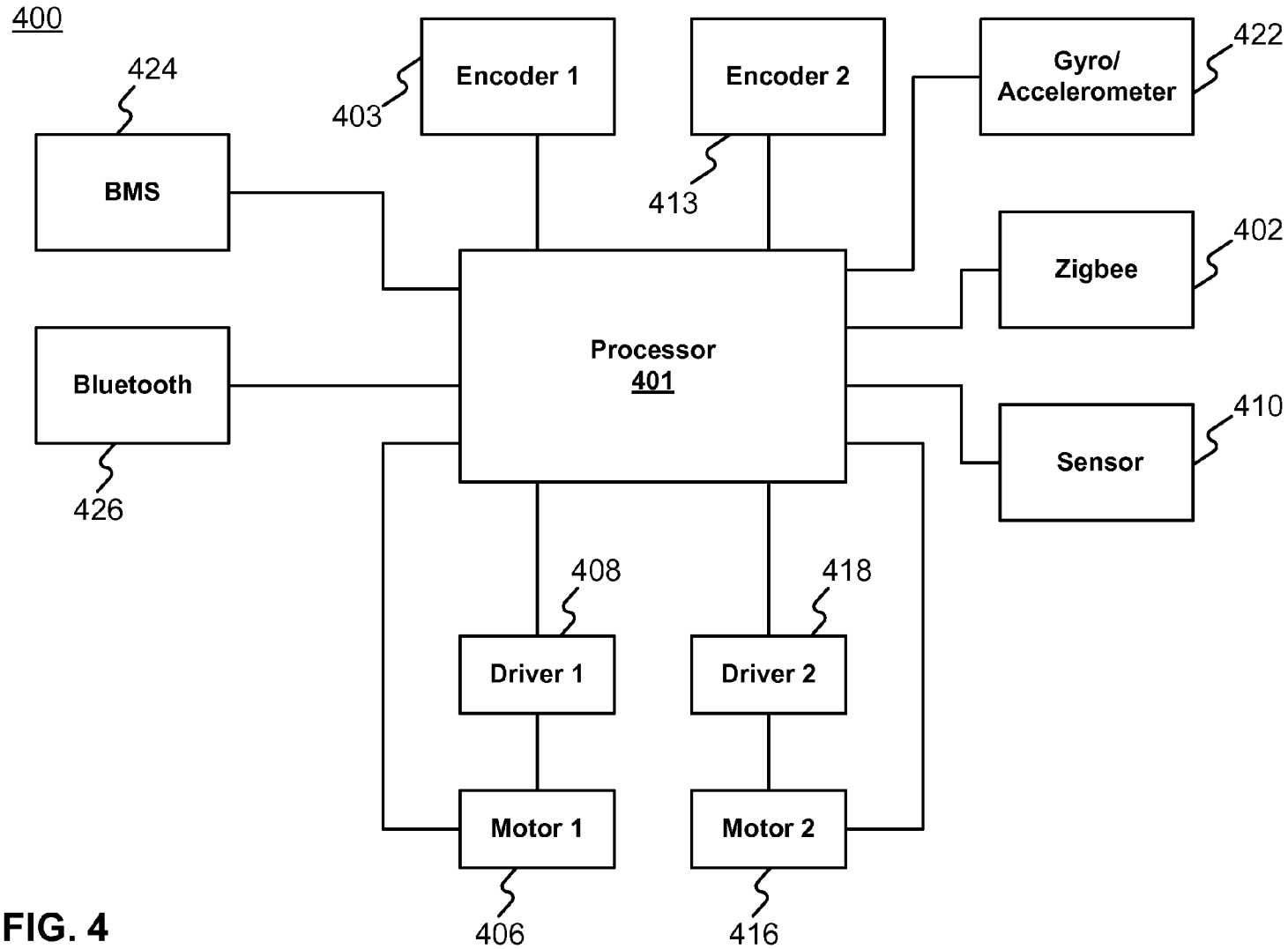
FIG. 4 is a functional block diagram of an exemplary skate, according to some embodiments of the present disclosure.

FIG. 4 is a functional block diagram of an exemplary skate 400 with two wheels (not shown). As shown in FIG. 4, skate 400 may include a processor 401; two encoders 403 and 413 each integrated in a wheel; two drivers 408 and 418 driving two motors 406 and 416, respectively; a sensor 410, a Zigbee module 402, a gyro/accelerometer 422, a Battery Monitoring System (BMS) 424, and a Bluetooth module 426. Processor 401 may communicate with sensors/modules by sending/receiving signals (analog or digital) to/from sensors/modules. In some embodiments, processor 401 may be any suitable standard processors. In some embodiments, processor 401 may be an ultra-low power RISC mixed signal microprocessor. Processor 401 can be any suitable off-the-shelf microprocessor available on the market that requires low power and is suitable for portable applications.

Processor 401 may receive input signals, such as signals indicating the tilting angles of horizontal portion 212, from sensor 410. Alternatively or additionally, signals indicating the tilting angles may be received from gyro/accelerometer 422. Gyro/accelerometer 422 may be any suitable motion-tracking device designed for the low power, low cost, and high performance requirements of smartphones, tablets and wearable sensors. Processor 410 may then control drivers 408 and 418, either collectively or individually, to drive motors 406 and 416, respectively, based on the tilting angle signals. Processor 401 may communicate with another skate through a transceiver, which can be a standard transceiver, for example, Zigbee module 402. In some embodiments, Zigbee module 402 may include a radio transceiver module that conforms to FCC certification standard. Zigbee module 402 may include an integrated PCB antenna, matching circuitry, and an interface for connecting to a wide range of devices. In some other embodiments, the transceiver may be a Bluetooth or other transceiver.

Processor 401 may communicate with encoders 403 and 413 to determine the speed or revolutions per minute (RPM) of each wheel. In some embodiments, encoders 403 and 413 may be integrated into motors 406 and 416, respectively. For example, encoder 403/413 may include a Hall effect sensor capable of determining the direction the wheel turns and how fast the wheel turns. Processor 401 may receive such information and determine the RPM of each wheel based on the information.

Processor 401 may communicate with a mobile device, such as a smart phone or a tablet, through another transceiver, which can be a Bluetooth module 426. In some other embodiments, the transceiver may be a Zigbee transceiver. Once the connection is established between the skate and the mobile device, user 102 may be able to control various aspects of the skate. For example, user 102 may use the mobile phone to turn on/off of the skate, checking battery information, monitoring wheel speed, recording travel distance, setting alarm, setting speed limit, choosing beginner/expert modes, etc. In addition, route information may be registered on a map of the mobile device if the mobile device is equipped with GPS. User 102 may be able to obtain the route history as well as current location of the skate in real time. This can help a parent to keep track of his/her kids, or allow user 102 to stay in touch with other skaters and friends via social media. In some embodiments, user 102 may choose between beginner mode and expert mode. In beginner mode, the top speed may be limited and the start/stop process may be configured to be slow and modest. In expert mode, user 102 may operate the skate with its full potential by going with full speed and have abrupt/sharp starting and/or braking. In short, different performance levels can be set up to map different experience levels.

Processor 401 may monitor the battery status through BMS 424. BMS 424 may allow constant monitoring of the battery for safety and state of charge. In some embodiments, BMS may be a sub-system connected to battery 304 or 314. BMS may monitor the voltage, temperature, the amount of charge left, etc. for each cell of battery 304 or 314. BMS may also monitor the overall battery (e.g., including one or more cells) charge and discharge rate. BMS may communicate with processor 401 to report monitored data. The data may then processed by processor 401 and may be used to control the skate system and/or to report to user 102 trough, for example, a mobile device used by user 102.

Figure 5:
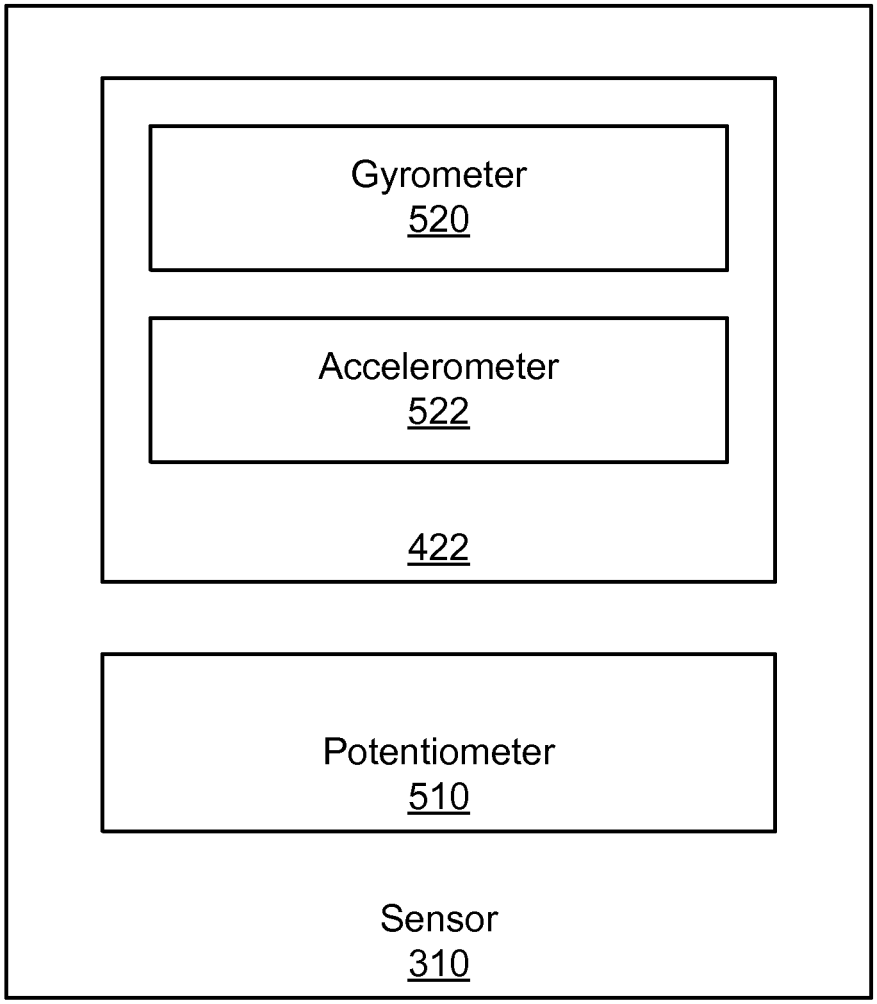
FIG. 5 is a functional block diagram of an exemplary sensor, according to some embodiments of the present disclosure.

FIG. 5 is a functional block diagram of an exemplary sensor 310. As discussed above, sensor 310 may detect the tilting angle of horizontal portion 212 and generate signals for start/stop and speed control. Sensor 310 may include a potentiometer 510. Potentiometer 510 may be a linear, rotating, or other type of potentiometer that moves with swing arm 222 of suspension system 220. In some embodiments, sensor 310 may include a gyro/accelerometer 422, which may include a gyrometer 520 and an accelerometer 522. Gyro/accelerometer 422 may determine the tilting angle and g-forces. For example, the tilting angle detected by gyro/accelerometer 422 may be with respect to sea level, while the tilting angle detected by potentiometer 510 may be with respect to ground surface. When the skate is operating on a slope, the tilting angles detected by potentiometer 510 and gyro/accelerometer 422 may be different. In some embodiments, the signals detected by both potentiometer 510 and gyro/accelerometer 422 may be processed together to improve signal quality because either device may produce false angles due to road imperfections such as bumps or slopes. The potentiometer may also be used in conjunction with these and other sensors.

In some embodiments, skating system 100 may function without a speed or torque equalization device. The user 102 may adjust the speed through resistance to one skate and/or the other skate.

FIGS. 1, 2A, 2B, and 3-5 and the description above illustrate an exemplary wearable motorized skating system, including the control system of the skating system. In some embodiments, the skates shown in FIGS. 1, 2A, 2B, and 3-5 and described above can be constructed as shown in FIGS. 1, 2A-2J, 3A-3B, 4, 5A-5B, 6A-6B, 7A-7B, 8, 9, 10A-10B, 11, 12A-12B, 13A-13B, and 14A-14B and described in Appendix A of U.S. Provisional Application No. 62/010,327, filed Jun. 10, 2014, the entire content of which is expressly incorporated herein by reference. Moreover, the control system illustrated in FIGS. 1, 2A, 2B, and 3-5 are not limited to apply to the skates described above, but can also be applied to other skates, for example, the skates described in U.S. Pat. No. 8,684,121, issued on Apr. 1, 2014, assigned to Acton, Inc., the content of which is incorporated herein by reference in its entirety. The control system illustrated in FIGS. 1, 2A, 2B, and 3-5 can be applied to various skating systems or movable systems, such as scooters, toy or real cars, characters in a game, luggage's having wheels that can rotate on the ground. For example, one or two users may want two scooters travel at around the same speed. The two scooters can incorporate the control system as disclosed in this disclosure, one acting as a primary and the other acting as a secondary. The control system disclosed above can also be incorporated on luggage's, one luggage acting as a primary and another acting as secondary. The secondary luggage can be configured to follow the primary luggage.

The skating system (or the above-described other applications, such as scooters, toy or real cars, characters in a game, luggage's) may have more than two skates. For example, one skate can configured as a primary skate, and more than one skates can be configured as secondary skates. The secondary skates can be configured to travel at the same speed as the primary skate. The control system can also be applied to different devices, for example, a skate/shoe and one or more luggage's. The skate/shoe can be configured as the primary, and the one or more luggage's can be configured as the secondary.

The specification has described a motorized skating system. The illustrated diagrams are set out to explain the exemplary embodiments shown, and it should be anticipated that ongoing technological development will change the manner in which particular functions are performed. Thus, these examples are presented herein for purposes of illustration, and not limitation. For example, steps or processes disclosed herein are not limited to being performed in the order described, but may be performed in any order, and some steps may be omitted, consistent with disclosed embodiments. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope and spirit of disclosed embodiments being indicated by the following claims.

What is claimed is:

1. A motorized skating system, comprising:
a primary skate and a secondary skate; and
at least one battery,
wherein the primary skate includes:
a horizontal portion configured to support a user of the motorized skating system;
a sensor configured to detect a tilting signal indicating a tilting angle of the horizontal portion;
at least one rear wheel coupled to the horizontal portion through at least one swing arm, the at least one swing arm being movably coupled to the horizontal portion;
a first processor configured to:
determine a first control signal for moving the primary skate based on the tilting signal;
determine a motion signal for moving the secondary skate based on the first control signal; and
monitor at least one of: temperature, voltage, current, and capacity of the at least one battery;
a first communication interface configured to send the motion signal to the secondary skate; and
wherein the secondary skate includes:
a second communication interface configured to receive the motion signal from the first communication interface of the primary skate; and
a second processor configured to determine a second control signal for moving the secondary skate based on the received motion signal.

2. The motorized skating system of claim 1, wherein the at least one swing arm is coupled to the horizontal portion through a linear or rotating potentiometer.

3. The motorized skating system of claim 1, further comprising:
a vertical portion coupled to the horizontal portion, and
a shock absorber connected to the vertical portion at one end and to the at least one rear wheel at the other end.

4. A motorized skating system, comprising:
a primary skate and a secondary skate; and
at least one battery,
wherein the primary skate includes:
a horizontal portion configured to support a user of the motorized skating system;
a sensor configured to detect a tilting signal indicating a tilting angle of the horizontal portion;
at least one rear wheel coupled to the horizontal portion through at least one swing arm, the at least one swing arm being movably coupled to the horizontal portion;
a first processor configured to:
determine a first control signal for moving the primary skate based on the tilting signal; and determine a motion signal for moving the secondary skate based on the first control signal;

a first communication interface configured to send the motion signal to the secondary skate; and wherein the secondary skate includes:

a second communication interface configured to receive the motion signal from the first communication interface of the primary skate; and a second processor configured to determine a second control signal for moving the secondary skate based on the received motion signal.

5. The motorized skating system of claim 4, wherein the at least one swing arm is coupled to the horizontal portion through a linear or rotating potentiometer.

6. The motorized skating system of claim 4, further comprising:

a vertical portion coupled to the horizontal portion, and a shock absorber connected to the vertical portion at one end and to the at least one rear wheel at the other end.

7. The motorized skating system of claim 4, wherein the sensor of the primary skate includes a potentiometer configured to detect the tilting signal.

8. The motorized skating system of claim 4, wherein the first processor is configured to determine whether the tilting signal is above a predetermined angle, wherein the predetermined angle corresponds to an angle greater than 0 degrees, wherein no power is applied to at least the primary skate for moving the primary skate in response to determining that the tilting signal is below the predetermined angle.

9. The motorized skating system of claim 4, wherein the primary skate includes a wheel system, the wheel system including:

at least one wheel;

a motor built in the at least one wheel; and a motor drive for driving the motor based on the first control signal, wherein the first processor is further configured to monitor one or more of: rotation speed of the wheel system, torque applied to the wheel system, power output by the motor drive, and state information of the motor.

10. The motorized skating system of claim 4, wherein the secondary skate includes a motor driving system configured to drive a wheel system, and wherein the motion signal includes information indicating at least one of torque to be applied to the wheel system, speed of the wheel system, power output by the motor driving system, or operation status of the primary skate.

11. The motorized skating system of claim 4, wherein the second control signal includes information for moving the secondary skate at a substantially same speed as the primary skate.

12. The motorized skating system of claim 4, wherein the second control signal includes information for moving the secondary skate at a different speed than the primary skate.

13. The motorized skating system of claim 4, wherein the second skate is configured to follow a motion of the first skate.

14. The motorized skating system of claim 4, wherein each skate includes identification information, the identification information comprising one or more of the following: a code, an address, a frequency, and a sequence of frequencies, and wherein each skate includes pairing information, the pairing information of the first skate including the identification information of the second skate, and the pairing information of the second skate including the identification information of the first skate.

* * * * *